US011788496B2

(12) United States Patent
Busato

(10) Patent No.: US 11,788,496 B2
(45) Date of Patent: Oct. 17, 2023

(54) FUEL DOSING VALVE

(71) Applicant: MRB MACHINING & FERRAMENTARIA LTDA., Paraná (BR)

(72) Inventor: Roderjan Busato, Paraná (BR)

(73) Assignee: MRB MACHINING & FERRAMENTARIA LTDA., Curitiba (BR)

( * ) Notice: Subject to any disclaimer, the term of this patent is extended or adjusted under 35 U.S.C. 154(b) by 82 days.

(21) Appl. No.: 17/091,791

(22) Filed: Nov. 6, 2020

(65) Prior Publication Data

US 2022/0120247 A1 Apr. 21, 2022

(30) Foreign Application Priority Data

Oct. 20, 2020 (BR) ..... 102020021497-7

(51) Int. Cl.
*F02M 51/06* (2006.01)
*F02M 61/18* (2006.01)

(52) U.S. Cl.
CPC ..... *F02M 51/0671* (2013.01); *F02M 61/18* (2013.01); *F02M 51/0685* (2013.01); *F02M 2200/9038* (2013.01)

(58) Field of Classification Search
CPC ..... F02M 61/168; F02M 2200/9038; F02M 61/18; F02M 51/0671; F02M 51/0685; F02M 51/061; H01F 7/1607
See application file for complete search history.

(56) References Cited

U.S. PATENT DOCUMENTS

| | | | | |
|---|---|---|---|---|
| 723,956 | A | 3/1903 | Weiss | |
| 1,396,978 | A | 11/1921 | Tacchella | |
| 1,664,616 | A | 4/1928 | French | |
| 1,970,801 | A | 8/1934 | Hurst | |
| 2,088,007 | A | 7/1937 | Zumbusch | |
| 3,004,720 | A | 10/1961 | Knapp et al. | |
| 3,241,768 | A | 3/1966 | Croft | |
| 3,669,361 | A | 6/1972 | Gueret | |
| 3,913,537 | A | 10/1975 | Ziesche et al. | |
| 4,590,911 | A | 5/1986 | Sciotti et al. | |
| 4,993,643 | A | 2/1991 | Schechter et al. | |
| 5,190,223 | A | 3/1993 | Mesenich | |
| 5,294,057 | A | 3/1994 | Hamilton | |
| 5,312,050 | A | 5/1994 | Schumann et al. | |
| 5,607,106 | A * | 3/1997 | Bentz | F02M 61/166 239/DIG. 19 |
| 5,626,292 | A | 5/1997 | Armaroli et al. | |
| 5,915,626 | A | 6/1999 | Awarzamani et al. | |
| 6,012,433 | A | 1/2000 | Buescher | |
| 6,112,720 | A | 9/2000 | Matta | |
| 6,131,829 | A | 10/2000 | Ricco | |

(Continued)

*Primary Examiner* — Christopher R Dandridge
(74) *Attorney, Agent, or Firm* — Sheridan Ross P.C.

(57) ABSTRACT

This invention refers to an optimized structure of a high flow fuel dosing valve applied to automobiles in general, particularly to high power racing cars with the purpose of opening and closing an orifice for fuel injection in internal combustion engines for power gain through an innovative and improved mechanical constructiveness of the coil body (1), coil (2), spring (3), needle (4), guide ring (5), lock (6), seat (7), sieve (8), needle body (9) and o-ring (10), with advantages of greater and faster fuel flow, durability, efficiency and power gain.

8 Claims, 21 Drawing Sheets

(56) References Cited

U.S. PATENT DOCUMENTS

| | | | | |
|---|---|---|---|---|
| 6,152,387 | A | 11/2000 | Ricco | |
| 6,168,094 | B1 | 1/2001 | Schatz et al. | |
| 6,206,304 | B1 | 3/2001 | Koseki et al. | |
| 6,244,525 | B1 | 6/2001 | Gallup et al. | |
| 6,279,843 | B1 | 8/2001 | Coldren et al. | |
| 6,345,601 | B1 | 2/2002 | Miyajima et al. | |
| 6,409,094 | B2 | 6/2002 | Tojo et al. | |
| 6,481,646 | B1 | 11/2002 | Hornby | |
| 6,502,767 | B2 | 1/2003 | Kay et al. | |
| 6,671,611 | B1 | 12/2003 | Peltier | |
| 6,679,435 | B1 | 1/2004 | Noller et al. | |
| 6,769,176 | B2 | 8/2004 | Hornby | |
| 7,136,743 | B2 | 11/2006 | Peltier | |
| 7,266,515 | B2 | 9/2007 | Costello et al. | |
| 7,407,120 | B1 | 8/2008 | French | |
| 8,316,825 | B1 | 11/2012 | French, III | |
| 8,857,743 | B2 | 10/2014 | Shingu et al. | |
| 2001/0022320 | A1 | 9/2001 | Tojo et al. | |
| 2002/0117557 | A1 | 8/2002 | Potschin et al. | |
| 2003/0019955 | A1 | 1/2003 | Schraudner et al. | |
| 2004/0158384 | A1 | 8/2004 | Kuegel et al. | |
| 2005/0167261 | A1* | 8/2005 | Deutchman | C23C 14/46 427/523 |
| 2009/0277433 | A1* | 11/2009 | Ward | F02P 3/02 123/634 |

* cited by examiner

FUEL DOSING VALVE

CROSS REFERENCE TO RELATED APPLICATIONS

This application claims the benefit of Brazil Patent Application No. BR102020021497-7 filed Oct. 20, 2020, the disclosure of which is incorporated herein by reference in its entirety.

FIELD

The present disclosure relates generally to fuel-dosing valves for internal combustion engines, and more particularly to high fuel flow fuel dosing valves.

BACKGROUND

By searching international patent databases, the following patents were found in the state of art:

U.S. Pat. No. 5,915,626 entitled "Fuel Injector" teaches a fuel injector includes a magnetic coil whose power dissipation is utilized to pre-heat fuel flowing through the fuel injector. The magnetic coil is arranged so that a thermal coupling between the magnetic coil and the fuel flowing through a heat exchanger segment is acquired. In addition, a Peltier element (which functions as a heat pump) can be arranged between the magnetic coil and the heat exchanger segment. Furthermore, the fuel can also be heated using a heating coil.

U.S. Pat. No. 8,857,743 entitled "Fuel Injection Valve" teaches the objective of realizing the structure, of a fuel injection valve, in which bouncing of the needle can be suppressed and the armature position can be fixed while the valve is closed, without increasing the number of components and the number of processes. In a fuel injection valve including an armature that is repelled or attracted by a core, by de-energizing or energizing a coil, a needle that opens or closes a valve seat in accordance with a reciprocal travel of the armature, and a valve-closing spring that biases the needle so as to close the valve, when the coil is de-energized, the valve-closing spring is disposed on the armature, and the needle and the armature are fixed in such a way that the armature can travel in an axis direction by a predetermined amount with respect to the needle.

U.S. Pat. No. 5,190,223A entitled "Electromagnetic Fuel Injector With Cartridge Embodiment" teaches a very fast electromagnetic fuel injector of cartridge design for the injection of fuel into the intake manifold of an internal combustion motor. The magnetic pole of the valve is mounted on a non-magnetizable casing which is solidly connected to a valve seat. This casing, together with the armature, the magnetic pole, and the valve seat, form a cartridge which can be manufactured independent from the other valve components. The cartridge is built into a valve housing which largely consists of plastic material. The fuel injector is therefore inexpensive to manufacture. In addition, the valve can be provided with a monostable polarized magnetic circuit.

The dosing valve disclosed in US patents U.S. Pat. Nos. 5,915,626, 8,857,743 e 5,190,223A, refer to its use in vehicles of lower performance (for conventional use), therefore their characteristics do not relate with the valve of the present disclosure.

U.S. Pat. No. 7,407,120B1 entitled "Adjustable Racing Injector" teaches An adjustable racing injector injects fuel by carrying out an opening and closing of a fuel orifice in a valve seat. The fuel orifice is controlled by a signal, typically provided by an engine control unit, which energizes a magnetic circuit including coil which in turn will effect movement of a needle. The adjustable racing injector is field reconfigurable and may be provided as discrete components, or may be provided as an assembly together with a collection of replaceable components that are designed to controllably alter the performance of an engine to which the injector is attached. All of the performance components may be readily replaced in the field, while still obtaining repeatable performance across a plurality of injectors.

U.S. Pat. No. 7,407,120B1, claims: "A fuel injector having field replaceable components exchangeable to change at least one of said fuel injector's characteristics, said fuel injector comprising:

- an electrical power connector adapted to receive a fuel injector energization signal;
- an electrical actuating coil electrically coupled to said electrical power connector and powered by said fuel injector energization signal to controllably produce a magnetic field;
- a ferromagnetically responsive needle movable responsive to variations in said magnetic field;
- a valve seat having a fuel passage there through, said fuel passage selectively closed or opened by said movement of said ferromagnetically responsive needle;
- a fuel inlet for receiving fuel into said fuel passage;
- a flow disk receiving fuel from said fuel passage and dispersing said fuel within an internal combustion engine;
- a housing enclosing said electrical actuating coil, said ferromagnetically responsive needle, said valve seat, and said flow disk, said housing having a fuel inlet and a fuel outlet and further having a field removable and replaceable closure which provides field access to and replacement of said field replaceable components and thereby change at least one of said fuel injector's characteristics;
- a longitudinally extensive valve seat location tube having a first end and a second end longitudinally distal to said first end, said first end capturing said valve seat adjacent said housing and further having a longitudinally extensive internal needle passage and longitudinal fuel flow passages terminating adjacent said valve seat, said longitudinal fuel flow passages separate from, parallel to and adjacent to said longitudinally extensive internal needle passage; and
- a valve seat lock mechanically engaging said housing and capturing said longitudinally extensive valve seat location tube therein."

U.S. Pat. No. 8,316,825B1 entitled "Adjustable Racing Injector" teaches an adjustable racing injector injects fuel by carrying out an opening and closing of a fuel orifice in a valve seat. The fuel orifice is controlled by a signal, typically provided by an engine control unit, which energizes a magnetic circuit including coil which in turn will effect movement of a needle. The adjustable racing injector is field reconfigurable and may be provided as discrete components, or may be provided as an assembly together with a collection of replaceable components that are designed to controllably alter the performance of an engine to which the injector is attached. Performance components that may be readily replaced in the field are preferably provided with visual indicia that indicate specific performance characteristics.

U.S. Pat. No. 8,316,825B1 claims: "1. A fuel injector having field replaceable components exchangeable to change at least one of said fuel injector's characteristics, said fuel injector comprising:

an electrical power connector adapted to receive a fuel injector energization signal;

an electrical actuating coil electrically coupled to said electrical power connector and powered by said fuel injector energization signal to controllably produce a magnetic field;

a ferromagnetically responsive needle movable responsive to variations in said magnetic field;

a valve seat having a fuel passage there through, said fuel passage selectively closed or opened by said movement of said ferromagnetically responsive needle;

a fuel inlet for receiving fuel into said fuel passage;

a flow disk receiving fuel from said fuel passage and dispersing said fuel within an internal combustion engine; and a housing enclosing said electrical actuating coil, said ferromagnetically responsive needle, said valve seat, and said flow disk, said housing having a fuel inlet and a fuel outlet and further having a field removable and replaceable closure which provides field access to and replacement of said field replaceable components and thereby change at least one of said fuel injector's characteristics;

each of said field replaceable components further comprising indicia which uniquely allow visual identification of a particular performance characteristic attained when said field replaceable components are incorporated into said fuel injector.

2. The fuel injector having field replaceable components of claim 1, wherein said housing further comprises a coil can assembly and a valve carrier, and said field removable and replaceable closure further comprises a valve seat carrier jam nut threadable onto said coil can assembly.

3. The fuel injector having field replaceable components of claim 1, further comprising:

a spring calibration tube effecting a first limit of longitudinal travel of said ferromagnetically responsive needle; and a needle spring urging said ferromagnetically responsive needle away from said spring calibration tube;

said spring calibration tube and said needle spring enclosed within said housing and removable and replaceable through said field removable and replaceable closure.

4. The fuel injector having field replaceable components of claim 1, further comprising:

a longitudinally extensive valve seat location tube having a first end and a second end longitudinally distal to said first end, said first end capturing said valve seat adjacent said housing and further having a longitudinally extensive internal needle passage; and a valve seat lock mechanically engaging said housing and capturing said longitudinally extensive valve seat location tube therein.

5. The fuel injector having field replaceable components of claim 1, further comprising a fuel tube defining said fuel inlet and passing at least partially through said electrical actuating coil.

6. The fuel injector having field replaceable components of claim 5, further comprising a fuel filter having a unitary seal keeper.

7. The fuel injector having field replaceable components of claim 6, wherein said fuel filter further comprises a coupler for removably coupling to said fuel tube.

8. The fuel injector having field replaceable components of claim 1, further comprising a needle guide nested removably within said valve seat.

9. The fuel injector having field replaceable components of claim 1, wherein said flow disk further comprises a sheet material having fuel flow passages formed therethrough.

10. The fuel injector having field replaceable components of claim 4, wherein said valve seat location tube further comprises longitudinal fuel flow passages terminating adjacent said valve seat, said longitudinal fuel flow passages separate from said longitudinally extensive internal needle passage.

11. The fuel injector having field replaceable components of claim 1 wherein each of said field replaceable components' indicia further comprises laser engraving.

12. A method for adjusting at least one fuel injector for internal combustion engine operation in an internal combustion engine having a plurality of fuel injectors, comprising the steps of:

assembling said at least one fuel injector comprising field replaceable performance altering components wherein the degree of performance alteration is not visually discernable from the physical geometry of said field replaceable performance altering components;

providing at least one substitute for at least one of said field replaceable performance altering components in a performance altering geometry having critical characteristics sufficiently matched to said at least one of said field replaceable performance altering components to enhance said internal combustion operation by replacement of one of said alternate configurations with another of said alternate configurations;

selecting said at least one substitute based upon visual indicia which uniquely identify aa grouping of performance altering characteristics which are different from said at least one of said field replaceable performance altering components, such that replacement of said at least one of said field replaceable performance altering components with said substitute will result in a desired performance alteration;

modifying said fuel injector fuel dispensing characteristics by replacing said at least one of said field replaceable performance altering components with said substitute.

13. The method for adjusting a fuel injector for internal combustion engine operation of claim 12, wherein said step of modifying further comprises exchanging said at least one of said field replaceable performance altering components with said substitute in all of said plurality of fuel injectors.

14. The method for adjusting a fuel injector for internal combustion engine operation of claim 12, further comprising the step of laser engraving visual indicia into said field replaceable performance altering components.

15. The method for adjusting a fuel injector for internal combustion engine operation of claim 12, wherein said step of modifying further comprises modifying a fuel injection fuel outlet opening.

16. The method for adjusting a fuel injector for internal combustion engine operation of claim 12, wherein said step of modifying further comprises modifying a fuel injection spray flow rate versus time profile during each injection cycle.

17. The method for adjusting a fuel injector for internal combustion engine operation of claim 12, wherein said step of modifying further comprises modifying a fuel injection response to electrical control.

18. The method for adjusting a fuel injector for internal combustion engine operation of claim 12, wherein said step of modifying further comprises modifying a fuel injector needle closing spring force.

19. The method for adjusting a fuel injector for internal combustion engine operation of claim 12, wherein said step of modifying further comprises modifying a fully opened injector needle height from said valve seat.

20. The method for adjusting a fuel injector for internal combustion engine operation of claim 12, wherein said step of modifying further comprises modifying a magnetic force exerted by an electrical actuating coil during an actuation control signal to said injector."

SUMMARY

The present disclosure refers to an optimized structure of a high flow fuel dosing valve applied to automobiles in general, particularly to high power racing cars with the purpose of opening and closing an orifice for fuel injection in internal combustion engines for power gain through an innovative and improved mechanical constructiveness with improved components and advantages of greater and faster fuel flow, durability, efficiency and power gain.

As it is known in the mechanical/technical field of fuel injectors and high-powered motor vehicles, there is a performance limitation of high-performance engines caused by low flow injectors. A limited performance is necessary for passenger cars or simply to reduce fuel consumption, yet it brings disadvantages of low process optimization, loss of energy by friction, noise generation and de-calibration when subjected to high loads.

The present disclosure began to be developed when the inventor, from his experience and practice of driving high performance or pulled cars, his knowledge and desire to obtain better results, realized that the valves available on the market were limited, so that the power of their car engines was not fully utilized. He created a line of research and development of these valves and, thus, he observed that the limitations, disadvantages and inconveniences of the valve came from not only one, but several of its components.

Each component or specification of a dosing valve changes its performance. The operation of the valve starts from the electrical signals received at its electrical terminals, which will transmit a signal to the coil, generating a magnetic field, which "attracts" the needle against the spring, thus opening the flow hole through which the dosing valve will inject the fuel, fed from the fuel pump, into the internal combustion engine.

The solutions revealed by patents shown above have disadvantages, limitations and drawbacks, such as limited performance, fragility, low durability, low reliability, low precision, low magnetization, turbulent flow and high load loss in fuel metering.

The high flow dosing valve object of this patent was developed to overcome the disadvantages limitations and drawbacks observed in the valves disclosed in the state of art, through optimized mechanical constructivity, with coil connections with gold-plated terminals, optimized and one-piece injector needle, optimized valve seat, single-format chamber, single-format valve lock and optimized valve body, which provides a higher fuel injection speed, with greater precision, better control and greater efficiency. The valve's characteristics were obtained through several developments to optimize performance and repeatability of results, in all ranges of engine speed and fuel flow in its use, bringing advantages of greater and faster fuel flow, linear efficiency in the flow during its operation, high fuel compression, efficiency, lower dead time, power gain, durability and repeatability.

The equipment revealed in the state of the art present the following technical problems, which the present process has solved:

A) Spring calibration tubes move above certain pressures, presenting a nozzle performance limitation. This problem is solved by the present disclosure with the replacement of spring calibration tubes by creating a seat hole in the coil body.

B) The current springs are unsuitable for the function required in high performance dosing valves, resolved by the present patent through the use of a larger diameter spring, greater length, greater spacing between windings and the use of material which is suitable for the function of the spring.

C) The current needles are assembled in two parts (and therefore have less mechanical resistance) and different materials (only magnetized upper part), so the magnetic flow is altered generating low magnetism, harming the needle's operation and the injection nozzle's response to the magnetic field. This problem is resolved by using a single body needle, made of fully magnetized material, with perfect operation.

D) The current needles have a longer internal hole (after the exit hole), generating a chamber at its end creating more turbulence in the fuel flow at its tip. This is solved by the present patent through an optimized positioning, angle and diameter, due to the unique material.

E) Current needles have less mechanical and chemical resistance and generate greater friction, decreasing their lifetime. This problem is solved by the present patent through a needle coated by the nitriding process and titanium coating, having less friction and greater surface hardness.

F) Current valve seats have a non-optimized geometry, which compromises the linearity of the flow, and the sealing ring is positioned in the lowest part of the seat. This problem is solved by the present patent through valve seats with geometry with 2 contact angles, one with the lock, one for needle sealing and 1 fuel outlet angle and positioning of the sealing ring in the center of the outer face of the seat thus generating gain of precision and stability in the flow.

G) The current locks are produced simply to lock the seal, without optimizing the flow of fuel and causing turbulence. This problem is solved by the present patent through a funnel-shaped angled chamber lock that avoids turbulence by optimizing the flow and gaining speed.

H) Current dosing valves are less efficient with high fuel pressure due to improper sizing of coil, needle and the material of the coil body. This is solved by the present patent through coil with adequate magnetic capacity, single body needle of fully magnetized material and the coil body being made of suitable material.

BRIEF DESCRIPTION OF THE DRAWINGS

For better understanding of the present disclosure, the following drawings are presented.

DETAILED DESCRIPTION

The high flow dosing valve object of this patent still brings the following advantages:

1. Linear flow efficiency during operation.
2. High fuel pressure.
3. Shorter dead time.
4. The injector works on any size of engine.

The device of the present disclosure was developed based on the knowledge and experience of the inventor in his previous technical research and development work with high performance or drag cars, and followed the following sequence:

The starting point was to expand the flow capacity of the fuel injector, in order to meet the need to obtain better results when compared to the injectors available in the high performance market for competition vehicles. Several developments were initiated to optimize the performance and repeatability of results, in all ranges of engine speed and fuel flow in its use.

The first problem observed by the inventor was the geometry of the valves. In the optimization process with carbon steel material, commonly used by current manufacturers, inventor found the problem of high magnetic memory with carbon steel material, which limits the needle's working speed. Thus, several tests were carried out with different materials with better magnetic properties for the construction of components of the coil and needle housing. After eight months of incessant tests with the noblest materials, inventor defined the use of material without magnetic memory with properties that met the conduction of the magnetic field in a satisfactory manner and at the desired level of aesthetic finishing.

Figure 1:
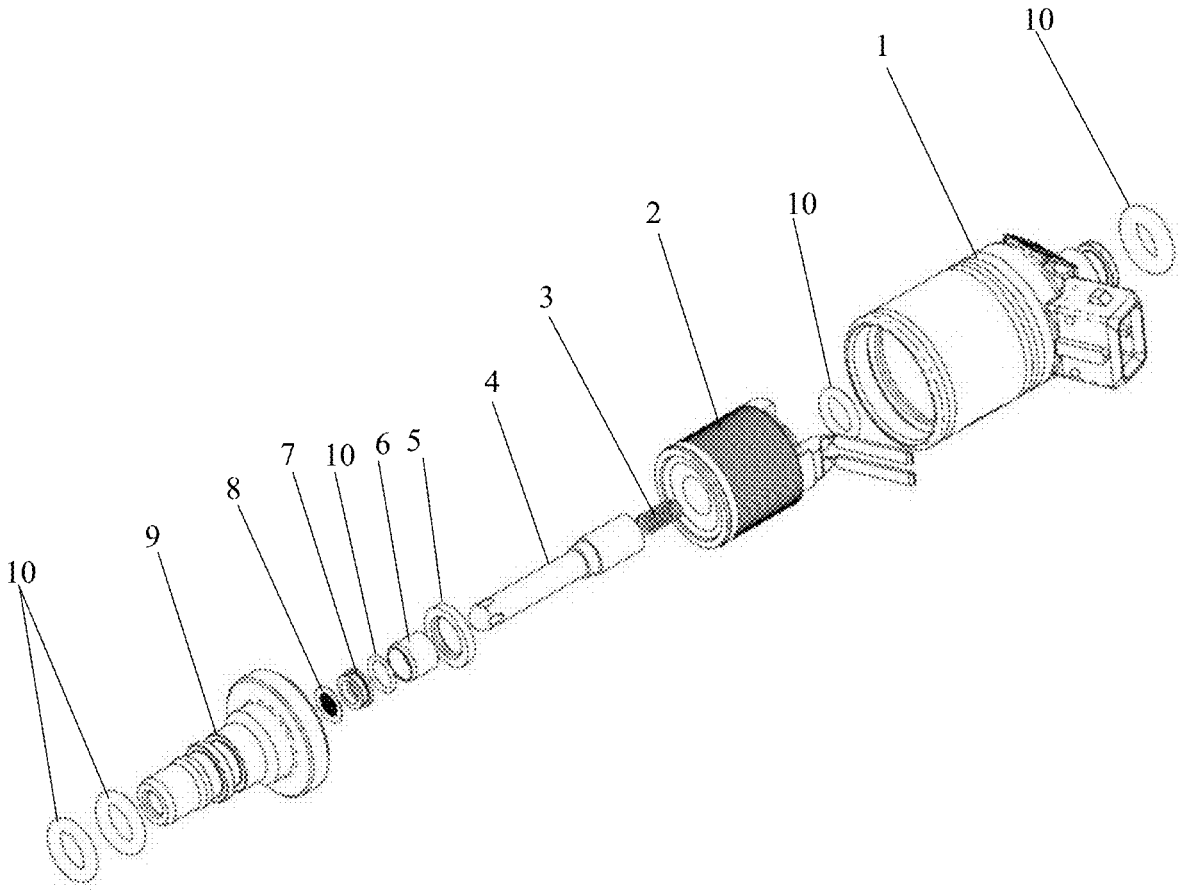
FIG. 1 shows the exploded perspective view of the dosing valve object of this patent.
Figure 2:
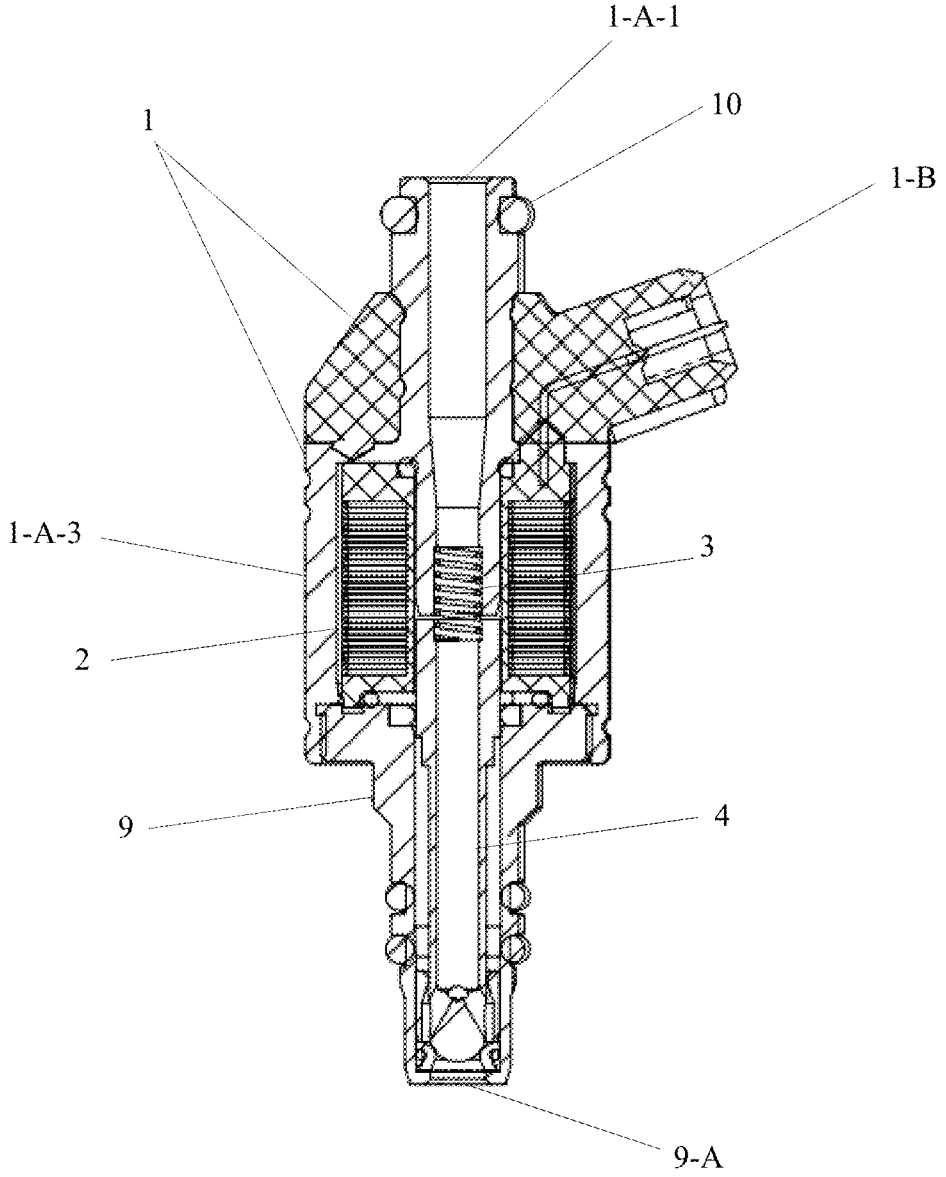
FIG. 2 shows the front sectional view of the dosing valve object of this patent.
Figure 3:
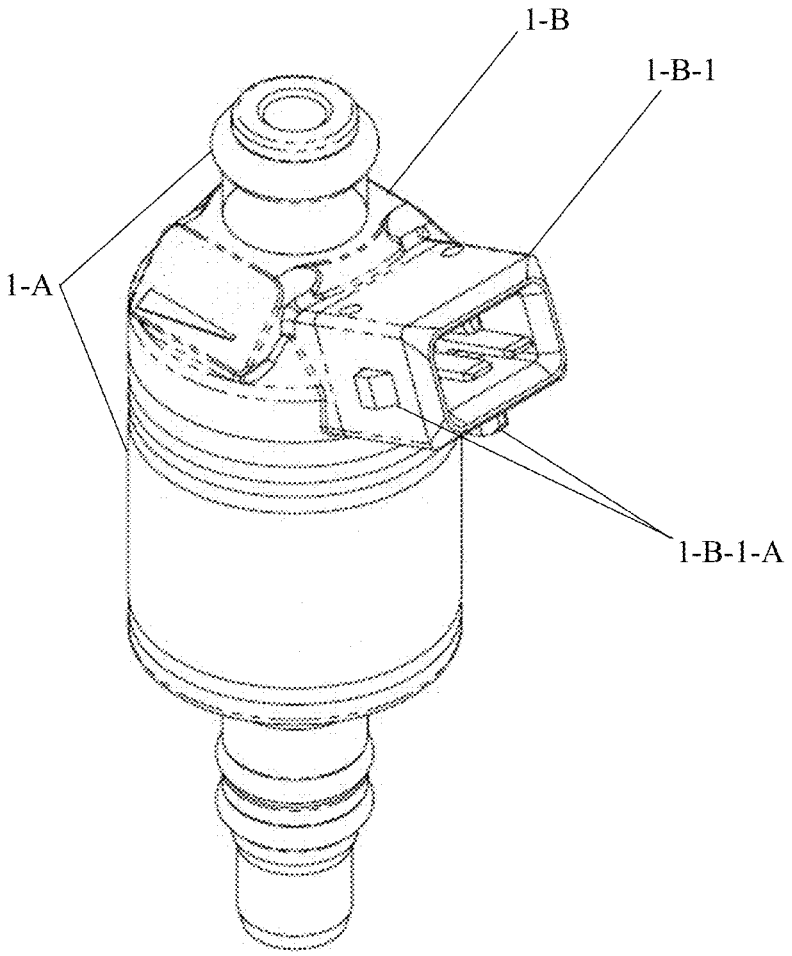
FIG. 3 shows front perspective view of the dosing valve object of this patent.
Figure 4:
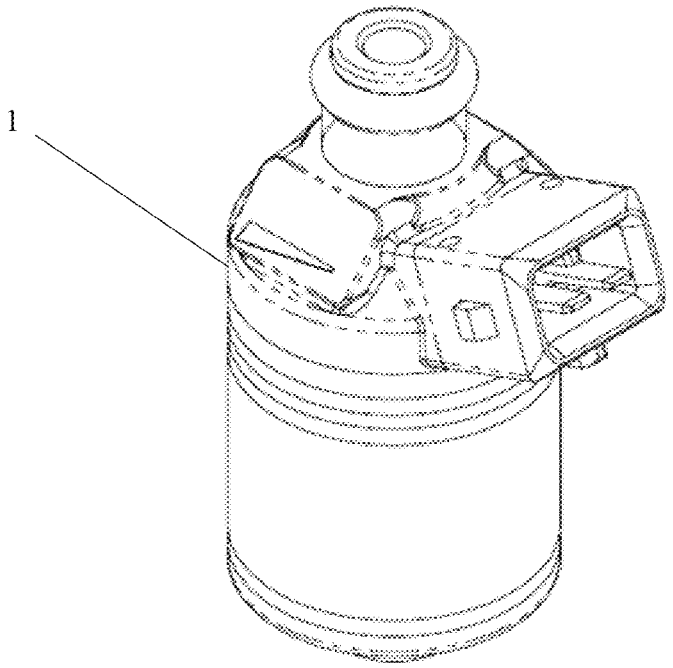
FIG. 4 shows the front perspective view of the coil body of the dosing valve object of this patent.
Figure 5:
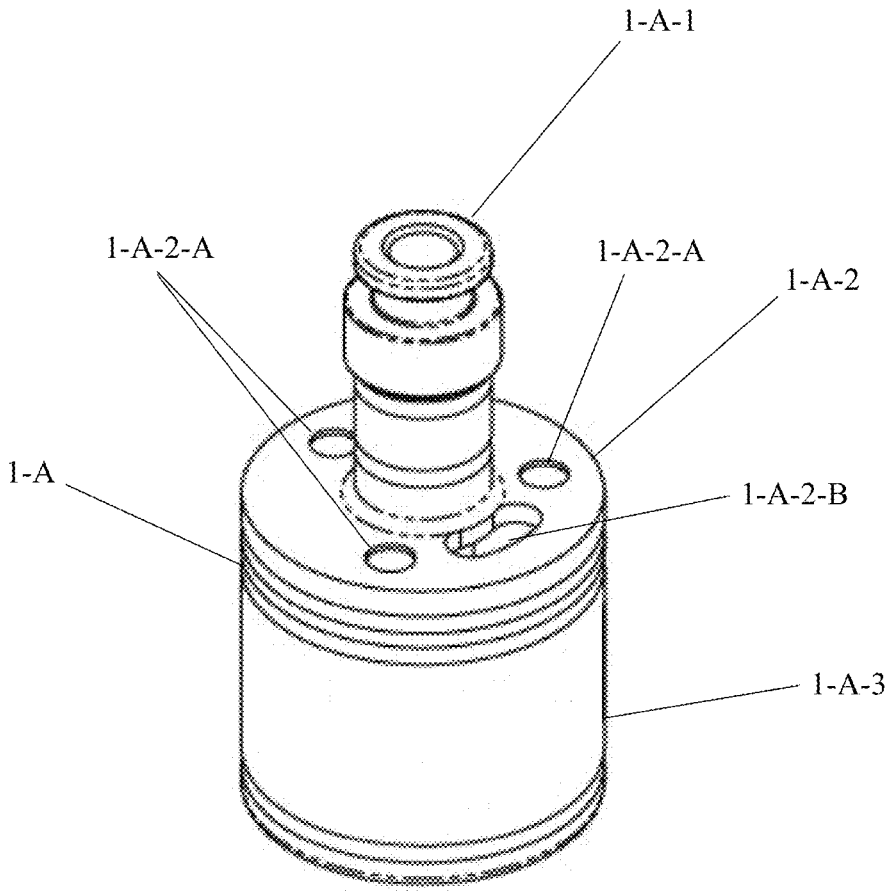
FIG. 5 shows the front perspective view of the bottom of the coil body of the dosing valve object of this patent.
Figure 6:
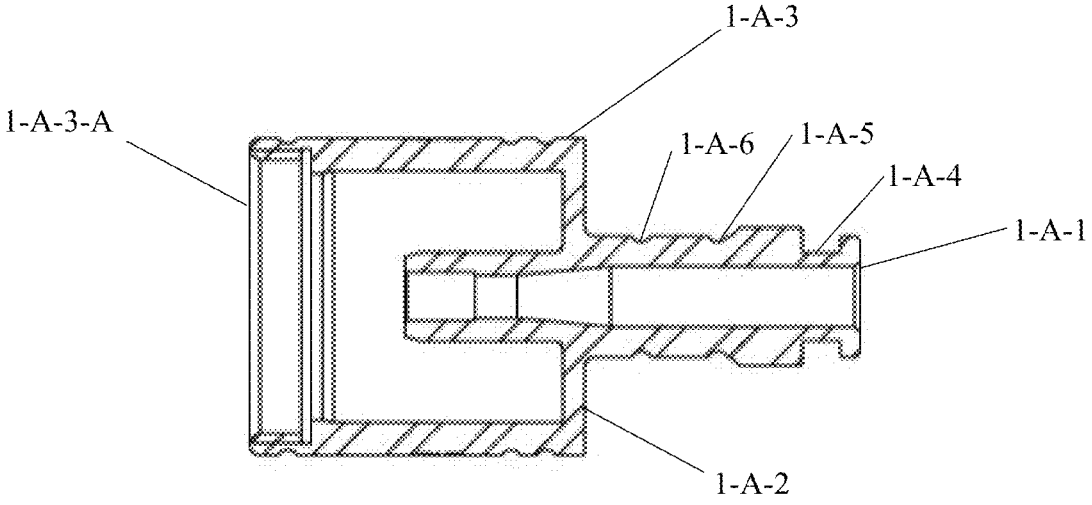
FIG. 6 shows the cross-sectional view of the coil body of the dosing valve object of this patent.
Figure 7:
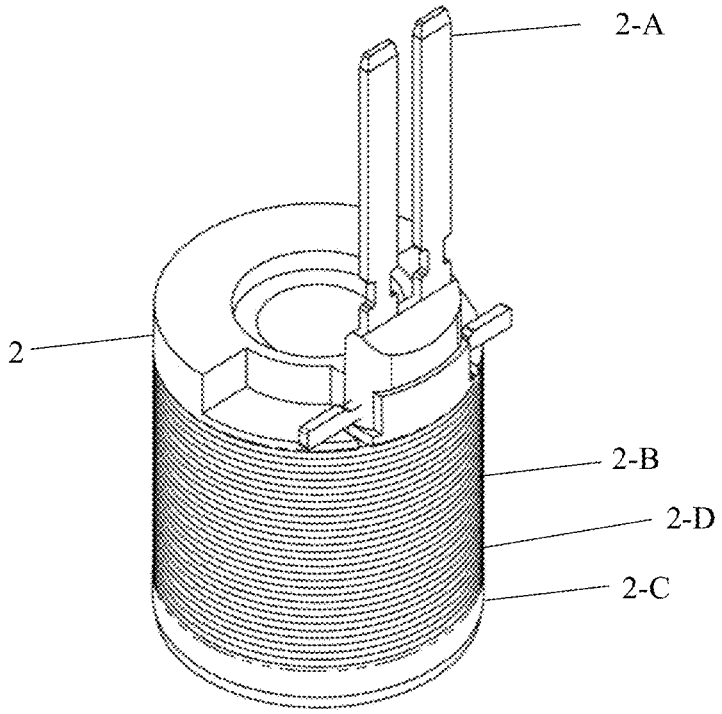
FIG. 7 shows the front perspective view of the coil of the dosing valve object of this patent.
Figure 8:
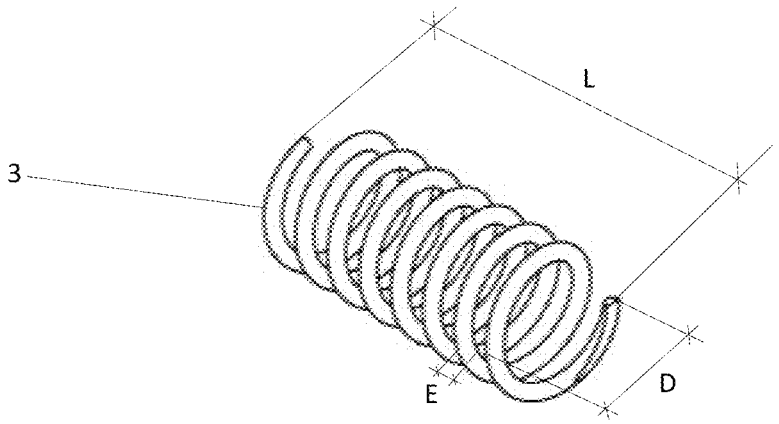
FIG. 8 shows the front perspective view of the spring of the dosing valve object of this patent.
Figure 9:
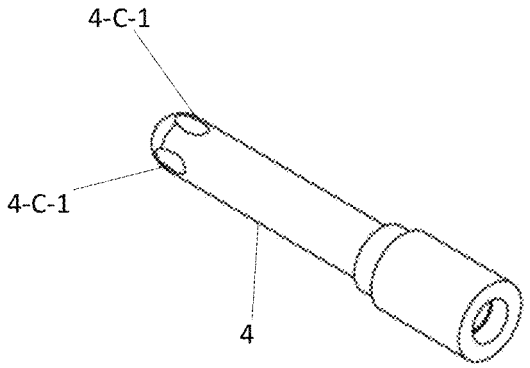
FIG. 9 shows the front perspective view of the needle of the dosing valve object of this patent.
Figure 10:
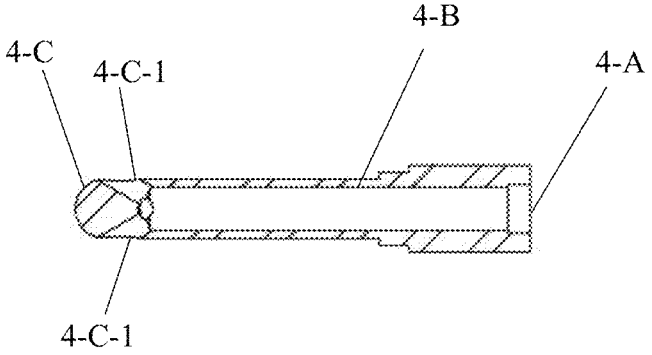
FIG. 10 shows the cross-sectional view of the needle of the dosing valve object of this patent.
Figure 11:
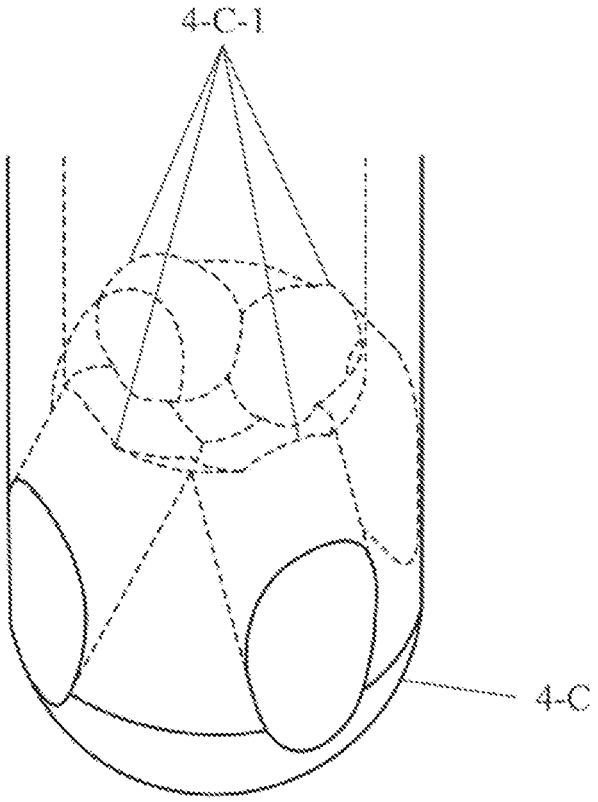
FIG. 11 shows the perspective view with transparency of the front wall of the enlarged needle tip of the dosing valve object of this patent.
Figure 12:
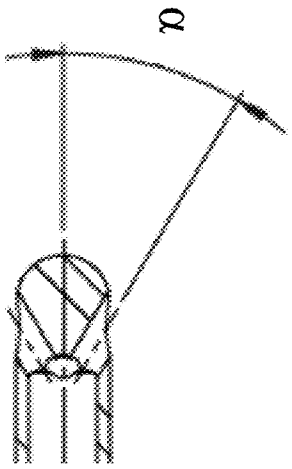
FIG. 12 shows in detail the angle of the inner needle hole the dosing valve object of this patent.
Figure 13:
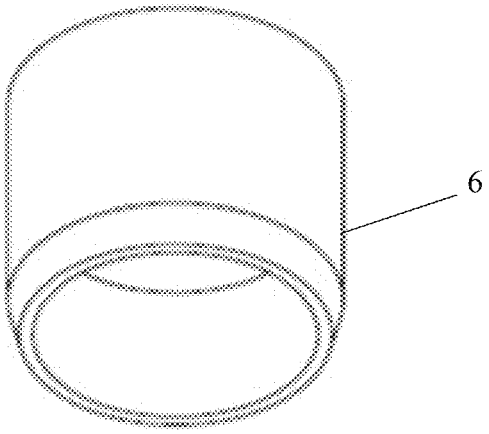
FIG. 13 shows the front perspective view of the lock of the dosing valve object of this patent.
Figure 14:
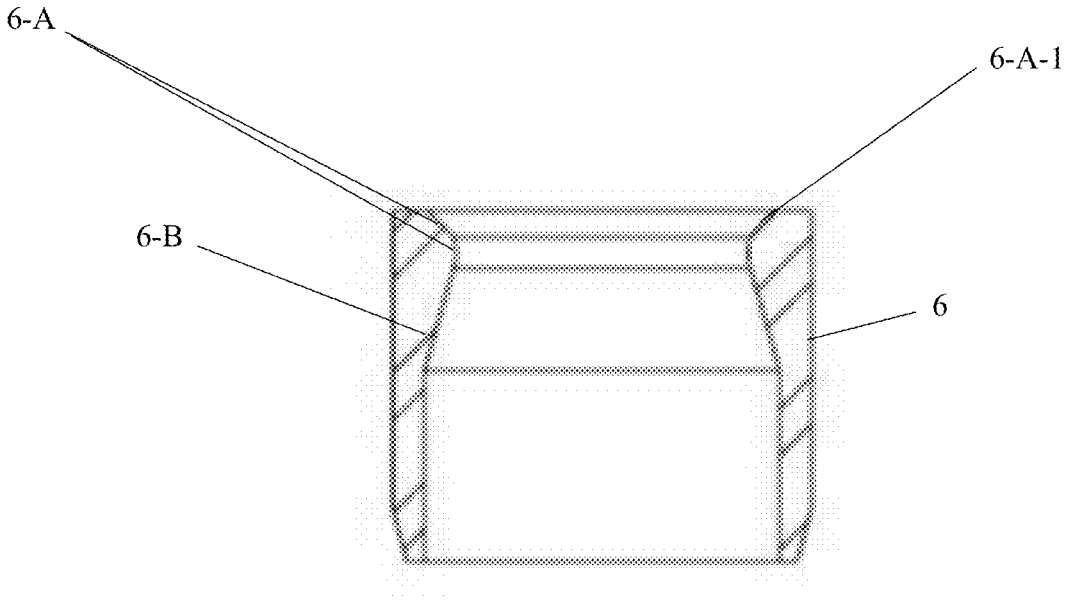
FIG. 14 shows the longitudinal section view of the lock of the dosing valve object of this patent.
Figure 15:
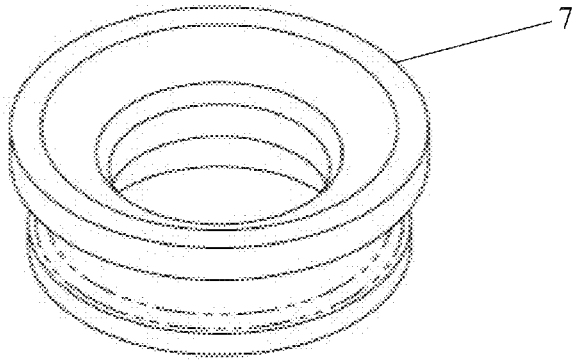
FIG. 15 shows the front perspective view of the seat of the dosing valve object of this patent.
Figure 16:
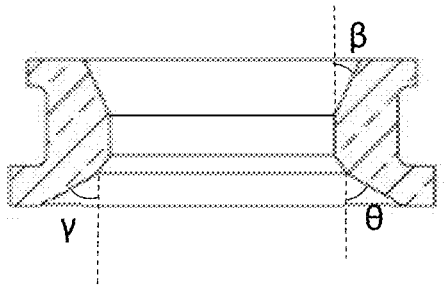
FIG. 16 shows the longitudinal section view of the seat of the dosing valve object of this patent.
Figure 17:
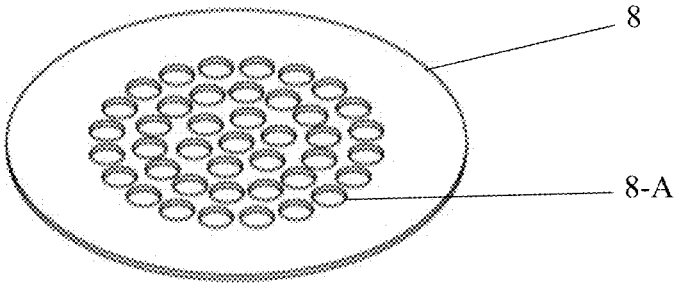
FIG. 17 shows the front perspective view of the sieve of the dosing valve object of this patent.
Figure 18:
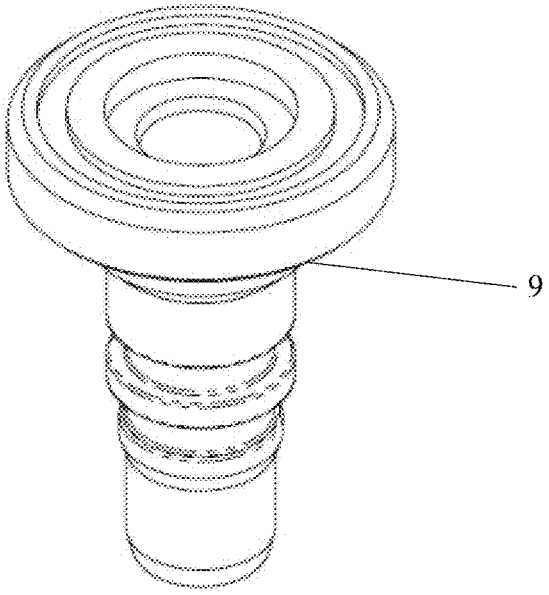
FIG. 18 shows the front perspective view of the needle body of the dosing valve object of this patent.
Figure 19:
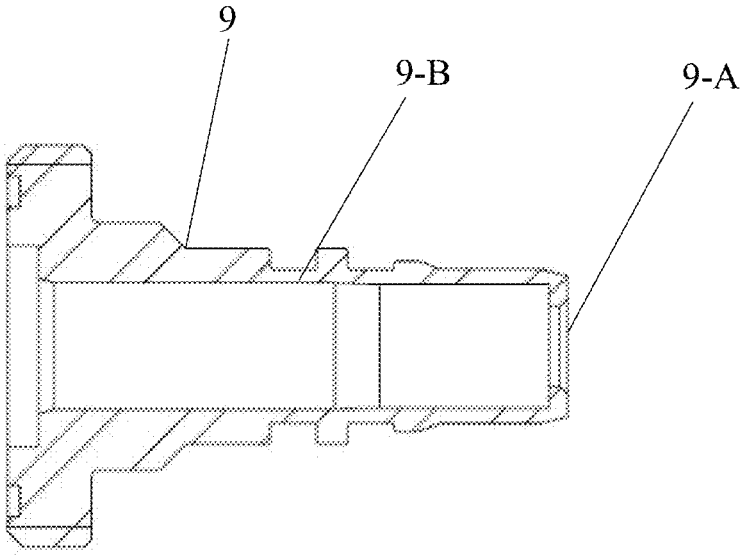
FIG. 19 shows the longitudinal section view of the needle body of the dosing valve object of this patent.
Figure 20:
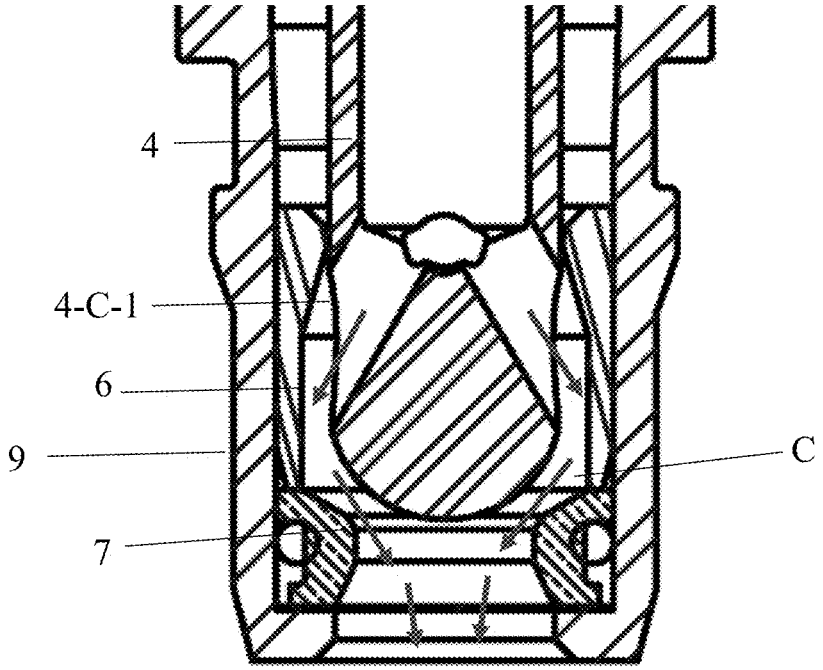
FIG. 20 shows the enlarged sectional view of the fuel chamber formed in the needle and its flow.
Figure 21:
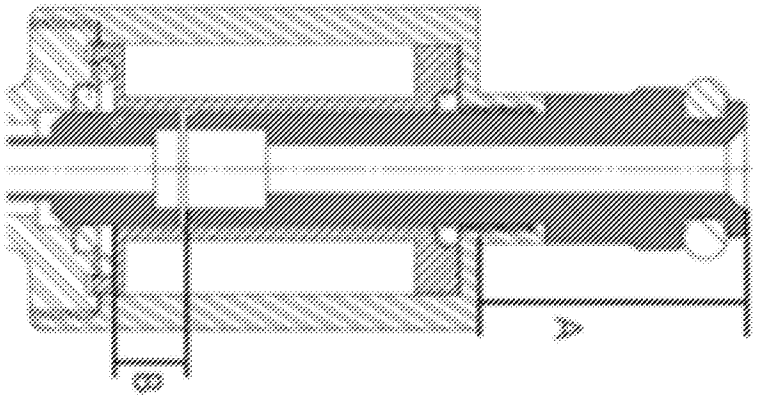
FIG. 21 shows the coil body in section and specific indicators from Table 1.

At the same time, inventor performed several tests for gap position variation needle lift space for the fuel outlet, in order to obtain improvements in the housing geometer, generating better conduction of the magnetic field, optimizing the magnetic attraction force in the opening of the needle, (Table 1 shows the results of the strength test x position of the 0.4 mm gap. In the first column, the best positioning of the needle in the coil core was studied, where the coil has more strength; second column shows the percentage the needle will enter the spool. See FIG. 21).

TABLE 1

| A (%) | % | Gap (mm) | V430FG 1 (kgf) | V430FG 2 (kgf) | 430F (kgf) |
|---|---|---|---|---|---|
| 34 | 0.0 | 0.4 | 2.760 | 2.730 | 2.300 |
| 35 | 1.0 | 0.4 | 2.770 | 2.750 | 2.400 |
| 36 | 2.0 | 0.4 | 2.780 | 2.790 | 2.380 |
| 37 | 3.0 | 0.4 | 2.840 | 2.810 | 2.370 |
| 38 | 4.0 | 0.4 | 2.910 | 2.760 | 2.360 |
| 39 | 5.0 | 0.4 | 2.750 | 2.740 | 2.270 |
| 40 | 6.0 | 0.4 | 2.630 | 2.460 | 2.100 |
| 41 | 7.0 | 0.4 | 2.600 | 2.480 | 2.050 |
| 42 | 8.0 | 0.4 | 2.590 | 2.410 | 2.060 |
| 43 | 9.0 | 0.4 | 2.580 | 2.480 | 2.040 |
| 44 | 10.0 | 0.4 | 2.590 | 2.500 | 2.060 |
| 45 | 11.0 | 0.4 | 2.570 | 2.420 | 2.050 |
| 46 | 12.0 | 0.4 | 2.590 | 2.370 | 2.070 |
| 47 | 13.0 | 0.4 | 2.590 | 2.470 | 2.050 |
| 48 | 14.0 | 0.4 | 2.570 | 2.430 | 2.050 |
| 49 | 15.0 | 0.4 | 2.560 | 2.490 | 2.060 |
| 50 | 16.0 | 0.4 | 2.540 | 2.510 | 2.020 |

By changing the material of the needle, inventor observed the possibility of improvement in its unique geometry, in order to provide a more fluid fuel channel, with a larger diameter and less rough internal finishing, therefore obtaining respectively greater fuel flow and less drag due to roughness. The material used was the same material as the coil body component, which has the characteristic of not having magnetic memory, which means that when the coil is energized, the needle is attracted immediately opening the fuel passage, and when the coil is de-energized, the needle loses its magnetic property and is forced to return immediately by the force of the spring plus the pressure of the fuel, thus sealing the fuel outlet.

For a better use of the modifications in the valve, it was necessary to develop a new spring and back of optimized geometry. Current dosing valves use a spring calibration tube, which is not efficient when subjected to great pressures and forces, causing its movement, thus eliminating the use of adjustment through a spring calibration tube, which is also applied in models of injectors to "calibrate" the spring force. In this way, it is possible to guarantee precise adjustment and the maintenance of the technical characteristics of operation during the life of the component when the product leaves the factory. Also to ensure that no adjustment is made to the injector, a spring was developed with exclusive characteristics of strength and dimensions to maintain the linearity of the operating and fuel injection characteristics.

Following the valve flow and engine performance tests, inventor found that it was possible to improve the efficiency of burning the injected fuel through an atomizing sieve. Thus, the sieve solution was applied to the outlet nozzle, with the optimization of the useful outlet area and a greater number of micro holes, in order to optimize the atomization of the fuel injected into the combustion chamber. The sieves were initially made with a 0.1 mm stainless steel sheet with laser cut, which caused the material's wingspan, roughness and darkening in the holes due to the effects of the laser cut temperature. The new sieves are being made with chemical cut, providing greater precision and cleaning.

To achieve full performance of the dosing valve, it was necessary to develop more robust fuel passage channels throughout the injector, maintaining the proportion of section areas through which the fuel passes, avoiding strangulation and favoring the flow to achieve the greater flow.

After developing the sieve, there was a need to improve the sealing seat, first favoring the flow of fuel through angles to better direct the fuel to the exit sieve, and then to ensure the tightness of the seal by contact with the needle, thus eliminating drips in the combustion chamber by residual pressure in the fuel line after the vehicle is switched off. Also, inventor used material with better mechanical properties, with non-deformation characteristics in the contact area of the seal, due to the impacts caused by the auto cycle in the opening and closing. Also in the external seal, with the use of a seal to put the O-ring on the tip and later a better result was observed by transferring the seal O-ring to the center in a cylindrical channel.

For the full operation of the entire device, it is necessary to eliminate all leaks. Thus, the coil housing and the fuel inlet channel were developed in a single geometry, in order to eliminate the leaks between the component assembly and guarantee the accuracy of operation the injector by reducing the components and assembly steps between them.

After finding the ideal mechanical specifications, electrical tests were necessary. After several tests observed in Table 2 (showing results of tests of coil variations) and Table 3 (showing results of tests variation of flow×tension), the coil body was increased in diameter to make the winding larger and generating magnetic field of greater intensity. Improvements were also made to the geometry of the terminal in the weld region, in order to avoid short-circuiting the housing. In the welding of the winding with the terminals, as well as in the coating of the supply terminals, noble material with greater electrical conductivity was used.

TABLE 2

| Coil | Resistance (ohms) | Inductance (L) | # of Windings | Length of Wire (m) | Dia. of Wire (mm) | Length of Coil Body (mm) |
|---|---|---|---|---|---|---|
| 1 | 980 | 0.3 | 218 | 8.85 | 25 | 21 |
| 2 | 915 | 0.34 | 247 | 10.54 | 24 | 25 |
| 3 | 1011 | 0.29 | 230 | 8.95 | 25 | 23 |
| 4 | 980 | 0.37 | 269 | 11.28 | 24 | 27 |
| 5 | 1300 | 0.13 | 164 | | 24 | 29.5 |
| 6 | 1200 | 0.16 | 168 | | 25 | 29.5 |
| 7 | 1800 | 0.4 | 252 | 11.83 | 25 | 29.5 |
| 8 | 1500 | 0.414 | 252 | | 25 | |
| 9 | 1700 | 0.7 | 340 | 14.4 | 0.5 | 17 |

TABLE 3

| Fuel pump pressure (psi) | With 8 Volt battery, flow rate (lb/h) | With 10 Volt battery, flow rate (lb/h) | With 12 Volt battery, flow rate (lb/h) | With 14 Volt battery, flow rate (lb/h) | With 16 Volt battery, flow rate (lb/h) |
|---|---|---|---|---|---|
| 30 | 441 | 435 | 440 | 437 | 422 |
| 35 | 476 | 475 | 472 | 475 | 459 |
| 40 | 511 | 510 | 509 | 503 | 498 |

TABLE 3-continued

| Fuel pump pressure (psi) | With 8 Volt battery, flow rate (lb/h) | With 10 Volt battery, flow rate (lb/h) | With 12 Volt battery, flow rate (lb/h) | With 14 Volt battery, flow rate (lb/h) | With 16 Volt battery, flow rate (lb/h) |
|---|---|---|---|---|---|
| 43.5 | 529 | 528 | 528 | 529 | 519 |
| 45 | 544 | 540 | 542 | 540 | 530 |
| 50 | 570 | 568 | 570 | 569 | 557 |
| 55 | 592 | 594 | 594 | 590 | 582 |
| 60 | 622 | 614 | 619 | 615 | 607 |
| 65 | 649 | 642 | 640 | 637 | 634 |
| 70 | 662 | 667 | 668 | 662 | 654 |
| 75 | 681 | 679 | 681 | 678 | 666 |
| 80 | 702 | 701 | 698 | 698 | 691 |
| 85 | 717 | 715 | 716 | 715 | 711 |
| 90 | 738 | 738 | 734 | 730 | 728 |
| 95 | 757 | 757 | 756 | 753 | 747 |
| 100 | 773 | 776 | 769 | 776 | 763 |
| 105 | 788 | 793 | 780 | 787 | 782 |
| 110 | 807 | 809 | 798 | 805 | 799 |
| 115 | 824 | 822 | 817 | 816 | 808 |
| 120 | | 836 | 850 | 829 | 836 |
| 130 | | 861 | 867 | 857 | 860 |

Still with the objective of guaranteeing the electrical isolation between the components, the plastic region in the passage of the terminals through the coil housing was increased.

Special resin was also applied to electrical components in the coil winding and in the region where the welding is carried out, thus preventing any electrical part from being exposed inside the injector and also as protection against damages in the assembly process.

According to the figures, the high flow fuel dosing valve comprises a coil body (1) made of ferritic stainless steel alloy material, with hollow staggered cylindrical-shaped PVD (physical vapor deposition) surface treatments made of DLC (Diamond-like Carbon), comprising hollow staggered cylindrical-shaped bottom of the coil body (1-A) comprising staggered (e.g., having portions of different diameters, whether due to the inclusion of recesses (e.g., 1-A-4, 1-A-5, 1-A-6) or otherwise) cylindrical-shaped fuel inlet channel (1-A-1) with recess (1-A-4) in the anterior external part for placement of the O-ring (10) and with cylindrical anterior inner part, conical central part and cylindrical posterior part and entering the interior of the housing (1-A-3), comprising circular-shaped lid (1-A-2) in the central part, with three circular recesses (1-A-2-A) and an oblong hole (1-A-2-B), comprising hollow cylindrical-shaped housing (1-A-3) with internal thread and cylindrical-shaped recess (1-A-3-A) forming the flap of needle body (9) and comprising a connector (1-B) molded externally on the bottom of the coil body (1-A) with a hollow parallelepipedal tip (1-B-1) with rectangular locks (1-B-1-A) on their sides for fixing the connectors; cylindrical-shaped coil (2) internally embedded to the housing (1-A-3) of the coil body (1), comprising two rectangular-shapes coil terminals (2-A) plated with high conductivity and low oxidation metal, comprising AWG24 copper wire windings (2-B), comprising base (2-C) in the shape of a hollow spool of thermoplastic polymer material with polyphenylene sulfide (PPS) and with addition of 40% fiberglass filler and comprising insulating resin (2-D); spring (3) of steel alloy material with silicon and chrome EN 10270-2 VD SiCr with length (L) in the range of 9 mm to 11 mm, with diameter (D) in the range of 3 mm to 5 mm, with number of windings from 8 to 15, wire thickness (E) 0.4 mm to 0.6 mm, positioned internally to the inlet channel (1-A-1), the recess (4-A) of the needle (4) and the coil (2);

single body needle (4) made of ferritic stainless steel alloy material, nitrided and coated with titanium nitride (TiN), cylindrical shaped, stepped on the external part and comprising recess (4-A) in the interior of its anterior part, where the spring (3) is accommodated, comprising cylindrical-shaped channel (4-B) with internal diameter in the range of 3.5 mm to 4.5 mm in its central part and comprising solid round tip with four cylindrical shaped holes (4-C-1) distributed at an angle (a) from 25° to 35° on its bottom; guide ring (5) of cylindrical shape 304 stainless steel material fitted around the needle (4); lock (6) made of cylindrical stainless steel material with a beveled outer front edge, with a funnel-shaped inner back (6-A) with a convex angle (6-A-1) at the beginning and a concave end (6-B) and involving the round tip (4-C); seat (7) made of alloy material chosen from bronze and brass with a stepped cylindrical shape, with an outer part provided with a recess in the center for fitting of the O-ring (10), with a stepped cylindrical internal part with three internal angles: (β) in the range of 23° to 27°, (θ) in the range of 33° to 37° and (γ) in the range of 58° to 62° and fitted in the lock (6); sieve (8) of disc-shaped stainless steel material with holes (8-A) with a diameter in the range of 0.4 mm to 0.6 mm each hole and fitted to the tip of the needle body (9); needle body (9) of ferritic stainless steel alloy material, plasma nitrided, with PVD (physical vapor deposition) surface treatments of DLC (Diamond-like Carbon) of staggered (e.g., having portions with different diameters) cylindrical shape on the outside with two recesses in its central part for fitting the O-ring (10) in the upper and lower recesses, comprising a cylindrical internal channel (9-B) and circular-shaped outlet hole (9-A), externally surrounding the needle (4), guide ring (5), lock (6), seat (7) and sieve (8).

The channel (4-A) of the needle has a variable diameter that depends on the desired flow in the dosing valve (e.g., the needle may be selected based on a diameter of the channel (4-A), so that the needle achieves the desired flow in the dosing valve), with a relationship between this diameter and the diameter of the four holes so that there is no flow restriction or turbulence due to load loss.

The lock (6) has a shape and dimensions so that, when it fits on the tip of the needle (4-C), there is no flow restriction or turbulence causing load loss.

Fuel chamber (C), with laminar flow, formed by the angle of the internal holes (4-B-1) of the needle (4), the internal angle of the seat (6) and the internal angle of the lock (7).

Reduction of dosing valve injection dead time, due to the combination of the coil body (1), coil (2), needle (4), needle body (5) forming a magnetic field with low magnetic memory and spring with effective elastic constant.

The dosing valve is assembled in the following sequence:

A) Assembly starts with the injection of the bases (2-C) and the coil terminals (2-A), in mold, with the thermoplastic polymer;

B) The bases (2-C) are wound with copper wire, in a machine suitable for winding coils (2);

C) Wires are welded at the terminals in a machine suitable for welding terminals (2-A);

D) The insulating resin (2-D) is applied;

E) Drying the insulating resin (2-D) in an oven;

F) Resistance, inductance and magnetic field measurements are carried out to verify that the measurements are within the standard, if not, they will be discarded and the steps will be restarted from B);

G) The coil (2) is assembled on the body, fitting an O-ring (9) for sealing and the coil (2) on it;

H) The lid for injection of the connector (1-C-1) is placed, applying a controlled torque, to ensure the sealing of the coil (2) in the body;

I) Fold the terminals (2-A) to ensure the correct position in the mold for injection of the connector (1-C-1);

J) Injection of the connector with special mold, in an injection machine for thermoplastics, with polymer additive with 30% glass fiber.

K) Laser engraving of information on all bodies for traceability of each valve;

L) Geometry measurements are made to ensure that the measurements are within the standard, for later assemblies. If not, they will be discarded and the steps will be restarted from G);

M) Assemble the needle body (9), place the sieve (8), the seat (7) with the O-ring (10) for sealing, the lock (6) and the guide ring (5), controlled torque is applied to the press to perform the assembly;

N) Assemble the needle guide ring (5) in a press with controlled torque and the needle (4) is inserted. In this stage, geometric quality measurements are performed to ensure the perfect operation of the injector;

O) In the coil body (1), the spring (3) previously measured in its length and the O-ring (10) for sealing the coil (2) with the needle body (9) are inserted;

P) The needle body assembly (9) is assembled to the coil body (1), applying controlled torque in an appropriate device;

Q) Tightness tests and the function test of the dosing valve in an appropriate machine are carried out for a determined time;

R) Measurement and adjustment of the injector gap is carried out, according to the model being manufactured;

S) Flow, static and dynamic tests and stability and repeatability tests are performed on the dynamometer. If not approved, return to the stage that corresponds to the detected problem; and T) Once approved in all stages, the injector goes to the final inspection and packaging.

The dosing valve operates in the following manner: the valve is controlled by electrical pulses generated by the engine control unit ("ECU") injection module (which may comprise, for example, a processor and a memory storing instructions for execution by the processor), which receives the signal from external variables such as RPM, TPS, MAP, battery voltage, pressure of fuel, among others, varying the frequency according to the combination of the inputs and generating an electrical signal for the excitation of the dosing valve. This signal passes through an electronic driver known as peak and hold 8 A/2 A in which the electric current is amplified to a peak of 8 amps and subsequently maintained at 2 amps. When receiving the signal from an electric pulse, the electric current travels through injector coil generating a magnetic field. This magnetic field exerts a magnetic force of attraction on the needle, which is that of the moving core of the coil. After being attracted by the magnetic force that the magnetic field exerts on the needle, it moves towards the fixed core, causing the existing seal, formed by the needle and the seat, to be undone thus releasing fuel.

The fuel flow operation process at the dosing valve follows the following sequence:

a) The fuel pump feeds the fuel in the channel (1-A-1);

b) The fuel in laminar flow follows the path in the channel (1-A-1) and crosses the spring (3);

c) The fuel in laminar flow follows from the spring (3) to the needle channel (4-B);

d) The ECU will release the energization signal to the coil terminals (2-A), causing the spring to contract;

e) Displacement of the needle forming the fuel chamber (C), releasing the flow of fuel laminarly through the channel (4-B), from the needle holes (4-C-1) to the fuel chamber (C);

f) Laminar flow through the chamber; and g) Fuel outlet through the sieve (8), in the outlet hole (9-A), for the combustion engine.

Laminar fuel flow may be achieved in fuel dosing valves according to embodiments of the present disclosure due to (1) an inlet channel in the valve without obstructions in in its path; (2) use of material with low friction coefficient; and (3) complementary angles between parts that enable continuous flow.

Example aspects of the present disclosure include:

A high flow fuel dosing valve, comprising:

a coil body made of ferritic stainless steel alloy material and having hollow staggered cylindrical-shaped physical vapor deposition surface treatments made of diamond-like carbon), the coil body comprising:

a hollow cylindrical-shaped housing with internal thread and cylindrical-shaped recess at a first end and a circular-shaped lid at a second end opposite the first end, the lid having three circular recesses and an oblong hole;

a hollow staggered cylindrical-shaped bottom extending from the lid and comprising a staggered cylindrical-shaped fuel inlet channel with a recess in an anterior external part for placement of an O-ring, the channel comprising a cylindrical anterior inner part, a conical central part, and cylindrical posterior part extending into the interior of the housing; and a connector molded externally around the cylindrical-shaped bottom, the connector comprising a hollow parallelepipedal tip and rectangular connector locks;

a cylindrical-shaped coil internally embedded in the housing of the coil body, the coil comprising:

two rectangular-shaped coil terminals plated with high conductivity and low oxidation metal;

AWG24 copper wire windings; and a base comprising a hollow spool of thermoplastic polymer material with polyphenylene sulfide, 40% fiberglass filler, and insulating resin;

a spring of spring-steel alloy material with silicon and chrome EN 10270-2 VD SiCr, the spring having a length in the range of 9 mm to 11 mm, a diameter in the range of 3 mm to 5 mm, from 8 to 15 windings, and a wire thickness of 0.4 mm to 0.6 mm;

a single body needle made of ferritic stainless steel alloy material, nitrided and coated with titanium nitride (TiN), the needle having a cylindrical shape and comprising:

a stepped external surface;

an anterior, interior recess for accommodating the spring;

a cylindrical-shaped channel with a central portion having an internal diameter in the range of 3.5 mm to 4.5 mm; and a solid round tip with four cylindrical shaped holes distributed at an angle ($\alpha$) from 25° to 35°;

a cylindrical guide ring made of 304 stainless steel material and fitted around the needle;

a cylindrical lock made of stainless steel material with a beveled outer front edge, a funnel-shaped inner back with a convex angle at the beginning and a concave end and involving the round tip;

a seat made of alloy material chosen from bronze and brass, the seat having a stepped cylindrical shape and comprising:

an outer part provided with a recess in the center for fitting of the O-ring;

a stepped cylindrical internal part fitted in the lock and having three internal angles: ($\beta$) in the range of 23° to 27°, ($\theta$) in the range of 33° to 37° and ($\gamma$) in the range of 58° to 62°;

a needle body made of ferritic stainless steel alloy material, plasma nitrided, with physical vapor deposition surface treatments of diamond-like carbon, the needle body having an external staggered cylindrical shape with upper and lower recesses each configured to receive an O-ring, the needle body comprising a cylindrical internal channel and circular-shaped outlet hole; and a disc-shaped sieve made of stainless steel material and comprising holes having a diameter in the range of 0.4 mm to 0.6 mm, the sieve fitted to the outlet hole of the needle body;

wherein the spring is positioned internally to the inlet channel, the recess of the needle, and the coil; the circular shaped recess of the housing forms a flap of the needle body; and the needle body externally surrounds the needle, guide ring, lock, seat, and sieve.

Any of the aspects herein, wherein the high conductivity and low oxidation metal plating of the two coil terminals is tin or a noble metal.

Any of the aspects herein, wherein the spring comprises a geometry and material that guarantee resistance to high intensity forces when subjected to high pressure.

Any of the aspects herein, characterized by needle (4) of material with low magnetic memory making the opening and closing of the valve faster and more precise, and of geometry with four holes in its rounded tip making the flow faster and more linear.

Any of the aspects herein, characterized by channel (4-A) of the needle having a variable diameter that depends on the desired flow in the metering valve, with a relation between this diameter and the diameter of the four holes, so that there is no flow restriction or turbulence due to load loss.

Any of the aspects herein, characterized by lock (6) with shape and dimensions that, when fitted to the needle tip (4-C), prevent flow restriction or turbulence causing load loss.

Any of the aspects herein, characterized by, fuel chamber (C), with laminar flow, formed by the angulation of the internal holes (4-B-1) of the needle (4), the internal angle of the seat (6) and the internal angle of the lock (7).

Any of the aspects herein, characterized by, opening of the holes (8-A) of the sieve (8) by precision chemical erosion.

Any of the aspects herein, characterized by, reduction of dead time of injection of the dosing valve, due to the combination of the components of the coil body (1), coil (2), needle (4), needle body (5) forming a magnetic field with low magnetic memory and spring with constant effective elastic.

Any of the aspects herein, characterized by, set of components with high pressure resistance due to their materials and geometries, working with motors (e.g., internal combustion engines) of any size and providing linear efficiency.

A high flow fuel dosing valve, comprising: a channel connectable to a fuel pump, the channel configured to receive fuel and to route the fuel across a spring and into a needle channel with the fuel in laminar flow; at least one coil comprising a terminal configured to receive, from an engine control unit, an electrical pulse, the electrical pulse generating a magnetic field as it pass through the coil; a spring configured to contract within the magnetic field; a needle in contact with the spring and having a tip with a plurality of needle holes, wherein contraction of the spring results in displacement of the needle, which displacement forms a fuel chamber and enables laminar flow of fuel through the needle channel and the needle holes into a fuel chamber; and a sieve positioned in an outlet hole of the fuel chamber, the outlet hole enabling fuel to flow laminarly through the fuel chamber and to drain from the fuel chamber.

A high flow fuel dosing valve, comprising:

a coil body having a physical vapor deposition surface treatment, the coil body comprising:

a hollow housing having a substantially cylindrical shape, a first end, and a second end opposite the first end;

a protrusion extending from the second end and partially defining a fuel inlet channel, the channel extending through the second end into the hollow housing and having an cylindrical anterior portion, a conical central portion, and a cylindrical posterior portion;

a coil positioned within the housing and comprising a base with copper wire windings and two coil terminals plated with high conductivity and low oxidation metal;

a spring;

a single-body needle made of a ferritic stainless steel alloy material and comprising a round tip comprising a plurality of holes distributed at an angle relative to a longitudinal axis of the single-body needle; an elongate channel in fluid communication with the plurality of holes; and an interior recess adapted to receive the spring;

a needle body made of a ferritic stainless steel alloy material, the needle body plasma nitrided and having a physical vapor deposition surface treatment, the needle body comprising a cylindrical internal channel and an outlet hole; and a disc-shaped sieve made of a stainless steel material and comprising a plurality of holes, the sieve fitted to the outlet hole of the needle body, wherein the spring is positioned internally to the fluid inlet channel, the interior recess of the needle, and the coil, and further wherein the needle is positioned within the needle body.

Any of the aspects herein, wherein the surface treatment of the coil body and of the needle body comprises diamond-like carbon.

Any of the aspects herein, wherein the coil body further comprises a connector molded externally around the protrusion, the connector configured to receive the two coil terminals and defining a receptacle.

Any of the aspects herein, wherein the two coil terminals are plated with a high conductivity and low oxidation metal.

Any of the aspects herein, wherein the copper wire windings comprise AWG24 copper wire.

Any of the aspects herein, wherein the base of the coil comprises a hollow spool made of thermoplastic polymer material comprising polyphenylene sulfide, fiberglass filler, and insulating resin.

Any of the aspects herein, wherein the spring is made of a spring-steel alloy comprising EN 10270-2 VD SiCr.

Any of the aspects herein, wherein the single body needle is nitrided and coated with titanium nitride.

Any of the aspects herein, wherein angle of the plurality of holes relative to the longitudinal axis of the single-body needle is between 25° and 35°.

The invention claimed is:

1. A high flow fuel dosing valve, comprising:

a coil body made of ferritic stainless steel alloy material and having hollow staggered cylindrical-shaped physical vapor deposition surface treatments made of diamond-like carbon), the coil body comprising:

a housing having a hollow cylindrical shape, the housing comprising an internal thread and a cylindrical-shaped recess arranged at a first end and a lid having a circular shape arranged at a second end opposite the first end, the lid comprising three circular recesses and an oblong hole;

a bottom having a hollow staggered cylindrical shape, the bottom extending from the lid and comprising a staggered cylindrical-shaped fuel inlet channel with a recess in an anterior external part for placement of an O-ring, the fuel inlet channel comprising a cylindrical anterior inner part, a conical central part, and cylindrical posterior part extending into an interior of the housing; and a connector molded externally around the bottom, the connector comprising a hollow parallelepipedal tip and rectangular connector locks;

a coil of a cylindrical shape that is internally embedded in the housing of the coil body, the coil comprising:

two rectangular-shaped coil terminals plated with a metal;

AWG24 copper wire windings; and a base comprising a hollow spool of thermoplastic polymer material with polyphenylene sulfide, 40% fiberglass filler, and insulating resin;

a spring of spring-steel alloy material with silicon and chrome EN 10270-2 VD SiCr, the spring having a length in a range of 9 mm to 11 mm, a diameter in a range of 3 mm to 5 mm, from 8 to 15 windings, and a wire thickness in a range of 0.4 mm to 0.6 mm;

a needle made of ferritic stainless steel alloy material, nitrided and coated with titanium nitride (TiN), the needle having a cylindrical shape and comprising:

a stepped external surface;

an interior recess disposed at a first end of the needle, wherein the interior recess is configured to accommodate the spring;

a cylindrical-shaped channel with a central portion having an internal diameter in a range of 3.5 mm to 4.5 mm; and a solid round tip with four cylindrical shaped holes distributed at an angle (a) from 25° to 35°;

a cylindrical guide ring made of 304 stainless steel material and fitted around the needle;

a cylindrical lock made of stainless steel material with a beveled outer front edge, a funnel-shaped inner back with a convex angle at a beginning and a concave end;

a seat made of alloy material chosen from bronze and brass, the seat having a stepped cylindrical shape and comprising:

an outer part provided with a recess in the center for fitting of the O-ring; and a stepped cylindrical internal part arranged adjacent to the cylindrical lock, the stepped cylindrical internal part having three internal angles: ($\beta$) in a range of 23° to 27°, ($\theta$) in a range of 33° to 37° and ($\gamma$) in a range of 58° to 62°;

a needle body made of ferritic stainless steel alloy material, plasma nitrided, with physical vapor deposition surface treatments of diamond-like carbon, the needle body having an external staggered cylindrical shape with upper and lower recesses each configured to receive an O-ring, the needle body comprising a cylindrical internal channel and a circular-shaped outlet hole; and a sieve having a disc shape, the sieve made of stainless steel material and comprising holes having a diameter in a range of 0.4 mm to 0.6 mm, the sieve fitted to the outlet hole of the needle body;

wherein the spring is positioned internally to the fuel inlet channel, the recess of the needle, and the coil; the cylindrical-shaped recess of the housing forms a flap of the needle body; and the needle body externally surrounds the needle, the cylindrical guide ring, the cylindrical lock, the seat, and the sieve.

2. The high flow fuel dosing valve of claim 1, wherein the metal plating of the two coil terminals is tin or a noble metal.

3. The high flow fuel dosing valve of claim 1, wherein the spring comprises a geometry and material that resists forces when subjected to fuel pressure.

4. The high flow fuel dosing valve of claim 1, wherein the needle is made from a material that is magnetic when the coil is energized and that is non-magnetic when the coil is de-energized.

5. The high flow fuel dosing valve of claim 1, wherein the cylindrical-shaped channel of the needle comprises a variable diameter between the first end of the needle and the four cylindrical shaped holes.

6. The high flow fuel dosing valve of claim 1, wherein the cylindrical lock is configured to fit with the solid round tip of the needle, and wherein, when the cylindrical lock is fitted to the solid round tip of the need, at least one of fuel flow restriction and fuel flow turbulence through the needle is prevented.

7. The high flow fuel dosing valve of claim 1, wherein a fuel chamber, with laminar flow, is formed by an arrangement of the four cylindrical shaped holes of the needle the internal angles of the seat, and the stepped cylindrical internal part of the cylindrical lock.

8. The high flow fuel dosing valve of claim 1, wherein the holes of the sieve are formed by chemical erosion.

* * * * *